United States Patent [19]

Barber

[11] Patent Number: 4,473,158

[45] Date of Patent: Sep. 25, 1984

[54] FILE HANGERS

[75] Inventor: Donald T. Barber, Toronto, Canada

[73] Assignee: Datafile Limited, Willowdale, Canada

[21] Appl. No.: 317,553

[22] Filed: Nov. 2, 1981

Related U.S. Application Data

[63] Continuation-in-part of Ser. No. 071,549, Aug. 31, 1979, Pat. No. 4,312,453.

[51] Int. Cl.[3] ..... A47F 7/16

[52] U.S. Cl. ..... 211/46; 211/162

[58] Field of Search ..... 211/46, 123, 47, 162, 211/126; 312/183, 184, 189, 193; 402/4

[56] References Cited

U.S. PATENT DOCUMENTS

| | | | |
|---|---|---|---|
| 3,606,948 | 9/1971 | Strang | 211/162 X |
| 3,913,995 | 10/1975 | Malcik | 211/46 X |
| 3,994,547 | 11/1976 | Sitler | 312/184 |
| 4,008,807 | 2/1977 | Phillips | 211/162 X |
| 4,056,296 | 11/1977 | Hedstrom | 312/183 X |
| 4,155,607 | 5/1979 | Sitler | 211/46 X |
| 4,182,532 | 7/1980 | Walker | 211/162 X |

FOREIGN PATENT DOCUMENTS

| | | | |
|---|---|---|---|
| 1216839 | 5/1966 | Fed. Rep. of Germany | 312/184 |
| 346861 | 7/1960 | Switzerland | 312/184 |

*Primary Examiner*—J. Franklin Foss

[57] ABSTRACT

The present invention provides a file hanging system consisting of a file edge backing member provided with a T-shaped portion having a pair of essentially identical arm portions and a bracket provided with a groove for engaging either one of the arm portions. The bracket includes a base flange and the file edge backing is provided with a raised portion to either side of the T-shaped portion. The system is one in which a file to which the file edge backing is affixed moves through file imbalance to a secured position on the bracket where the bracket base flange is trapped between the T-shaped portion and the raised portion on the file edge backing.

4 Claims, 14 Drawing Figures

FILE HANGERS

This is a Continuation-In-Part patent application of U.S. patent application Ser. No. 071,549; now U.S. Pat. No. 312,453 filed Aug. 31, 1979.

FIELD OF THE INVENTION

The present invention relates to a file hanging system in which a supporting bracket and a file edge backing are adapted to cooperate with one another for hanging a file to which the backing is affixed in a secured position on the bracket.

BACKGROUND OF THE INVENTION

Conventional file hanging systems are generally of the type in which a hook is provided at each end of the file for hanging the file from a pair of supporting rods or bars. Typical arrangements are shown in U.S. Pat. Nos. 3,667,854 issued June 6, 1972 to F. D. Jonas and 3,779,393 issued Dec. 18, 1973 to Carl E. Grundell.

Filing systems such as those described above, can be very awkward to work with. The files on which they are used are not as a general rule, readily accessible or suitable for use in a covered filing cabinet because the files must be dropped into hanging positions from above the supporting rods. Furthermore, the use of a pair of supporting rods take up significant office space which might be otherwise used.

As an alternative, arrangements such as those shown in U.S. Pat. No. 3,980,360 issued Sep. 14, 1976 to Wright et al and 4,056,296 issued Nov. 1, 1977 to Hedstrom et al; have been provided with a securing hook for use in hanging the file. These arrangements are somewhat better than those described above, in that only a single supporting bracket is required and the file is mounted from the side of the bracket as opposed to from above the bracket. However because of the shaping of the hook member, and its sunken location, manipulation of the file is still required to get the hook on and off the supporting rod. Furthermore, because the hook is open at one side only, the file must be turned in the proper direction prior to hanging it from the supporting rod which can be difficult when working in a crowded area.

My copending U.S. patent application Ser. No. 71,549 mitigates many of the problems referred to above in that the files are much easier to work with and require very little manipulation to move them in and out of a hanging position. According to my copending patent application the files are supported by a frictional or binding engagement between the file edge backing and the bracket from the which the files are supported.

SUMMARY OF THE PRESENT INVENTION

The file hanging system of the present invention consists of a file edge backing which is affixed along the edge of a file which is provided with a T-shaped member adapted to fit into a supporting bracket. The T-shaped member includes a pair of essentially identical arm portions and the bracket is provided with a groove for engaging either one of the arm portions. The T-shaped member is positioned at a point of balance on the file edge backing such that when it is inserted into the groove of the bracket, the weight of the file on which the file edge backing is affixed, moves the T-shaped member to a supported position in the groove regardless of its direction of insertion into the bracket.

The file edge backing is provided with a raised portion to either side of and spaced from the T-shaped member. This raised portion moves through the file imbalance beneath the bracket upwardly to a trapping position relative to a base flange on the bracket on the opposite side of the bracket, from which the T-shaped member is inserted to trap the base flange between the T-shaped member and the raised portion.

Since there are no complicated hook arrangements and the like involved, the file is not only extremely easy to locate in the proper position for hanging, but is also very easy to remove from the hanging position. The automatic self-locking feature of the present invention makes what would appear to be an otherwise unacceptable groove and T-member arrangement, extremely functional and easy to work with.

Furthermore, the locking of the file edge backing on the bracket by means of the T-shaped member and the raised portion of the backing, substantially eliminates the problem of inadvertantly pulling out files other than those desired from a crowded filing system in which the side-by-side files frictionally engage one another.

BRIEF DISCUSSION OF THE DRAWINGS

The above, as well as other features and advantages of the present invention will be described in greater detail according to the preferred embodiments of the present invention wherein.

Figures 3, 3A, 3B:
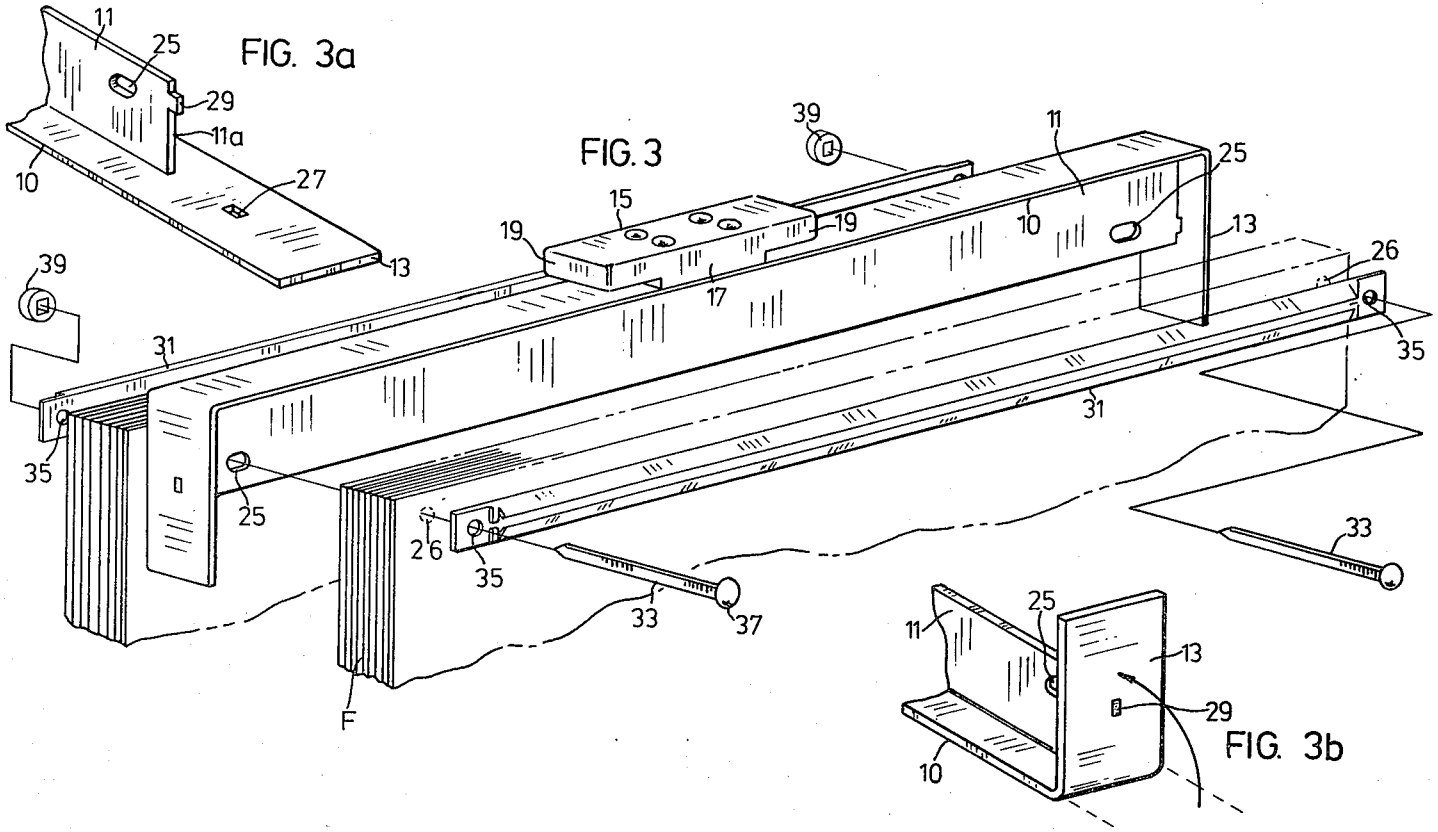
FIG. 3 is an exploded view of a file backing means according to an embodiment of the present invention used in conjunction with a file binding system.

FIG. 3*b* shows one end of the file edge backing means of FIG. 3 after assembly.

FIG. 3*a* shows one end of the file edge backing means of FIG. 3 prior to assembly.

Figure 1:
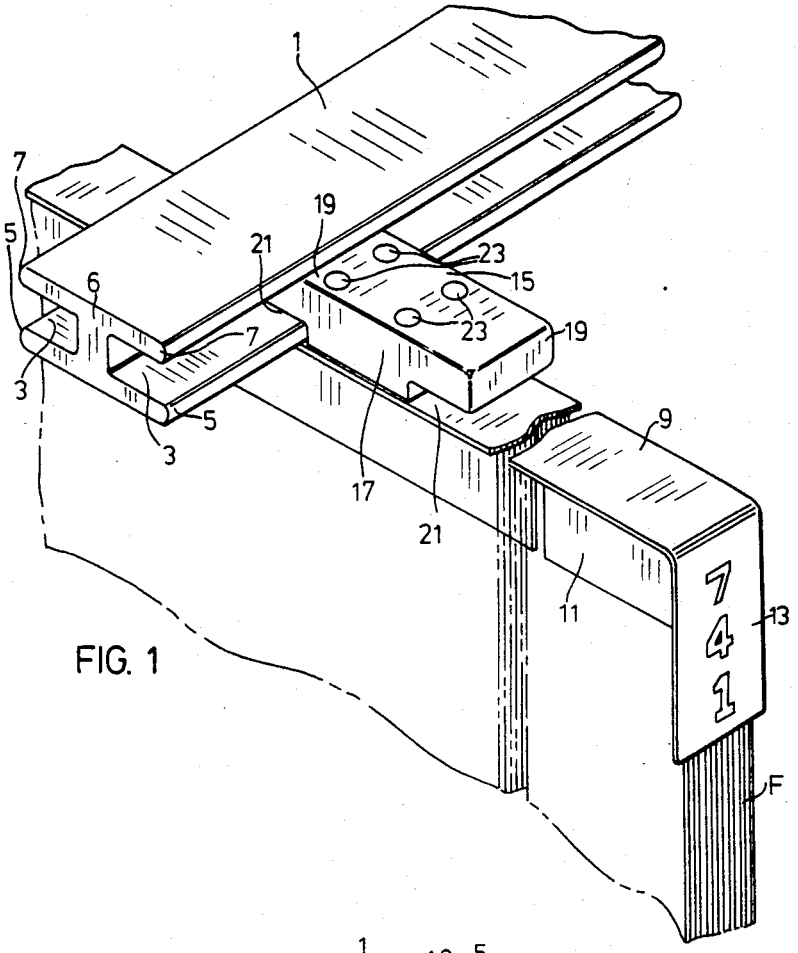
FIG. 1 is a perspective view looking down on a preferred arrangement of a file hanging system according to the present invention.
Figure 2:
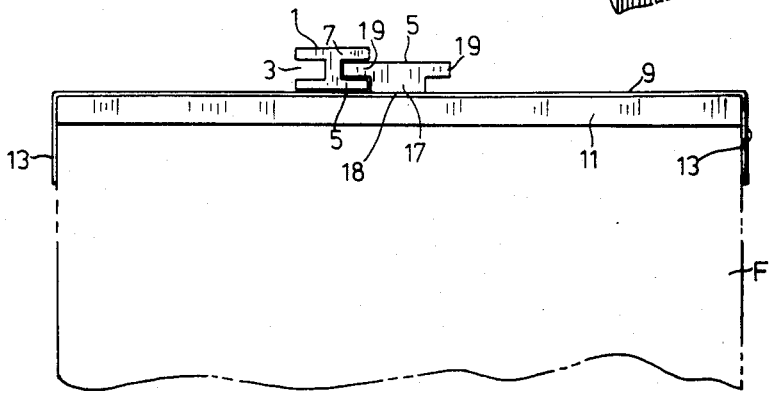
FIG. 2 is a side view of the arrangement shown in FIG. 1.
Figure 4:
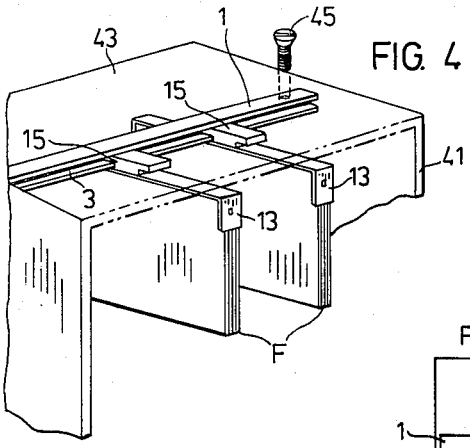

FIG. 4 is a perspective view looking down through a covered filing cabinet employing the file hanging system of FIGS. 1 and 2.

Figure 5:
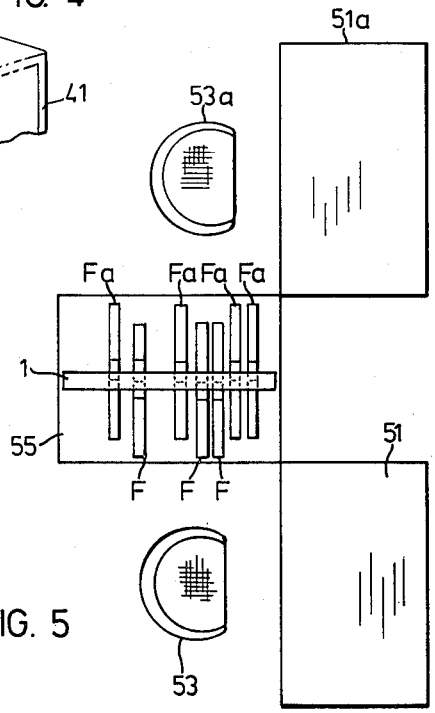

FIG. 5 is a top view looking down on a file hanging system as shown in FIGS. 1 and 2 wherein files are hung from either side of the supporting bracket.

Figure 6:
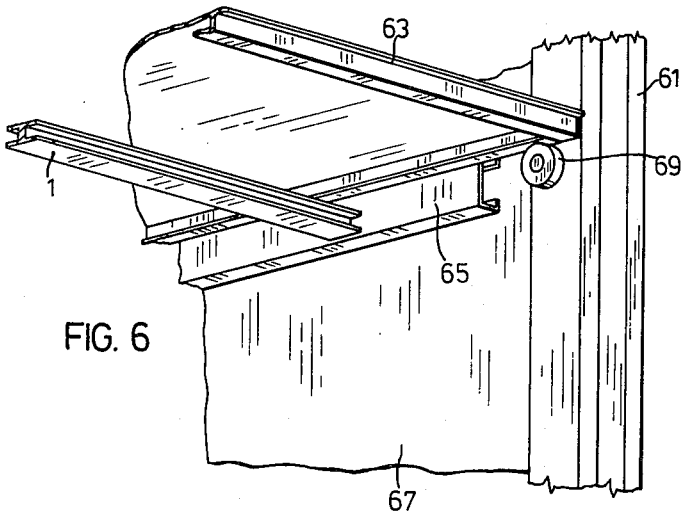

FIG. 6 is a perspective view showing a preferred form of a supporting bracket according to the present invention in a different type of closed cabinet from that shown in FIGS. 4 and 5.

Figure 7:
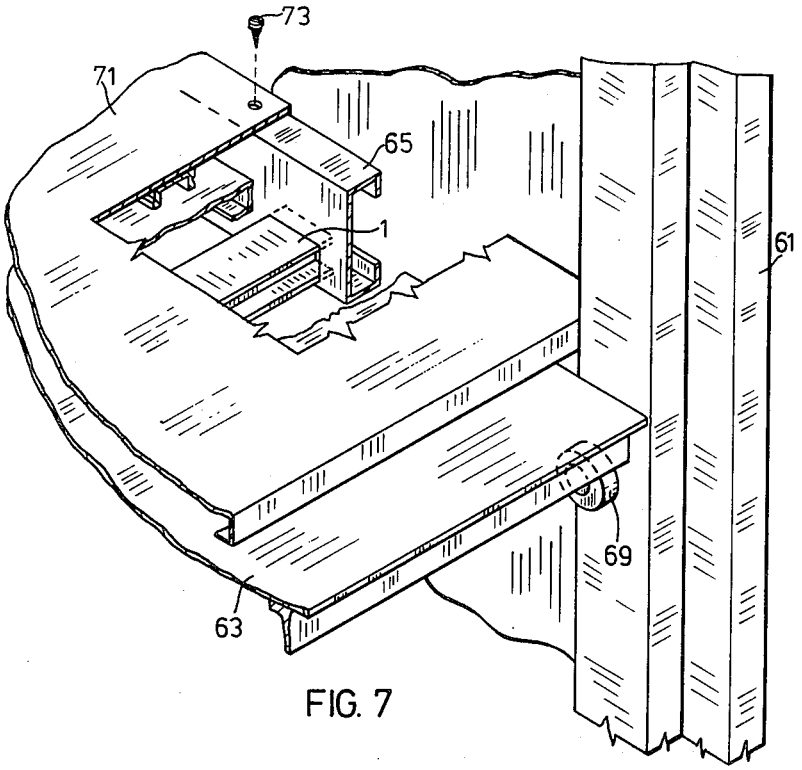

FIG. 7 is a partially cut-away perspective view looking down on the cabinet system shown in FIG. 6.

Figure 8:
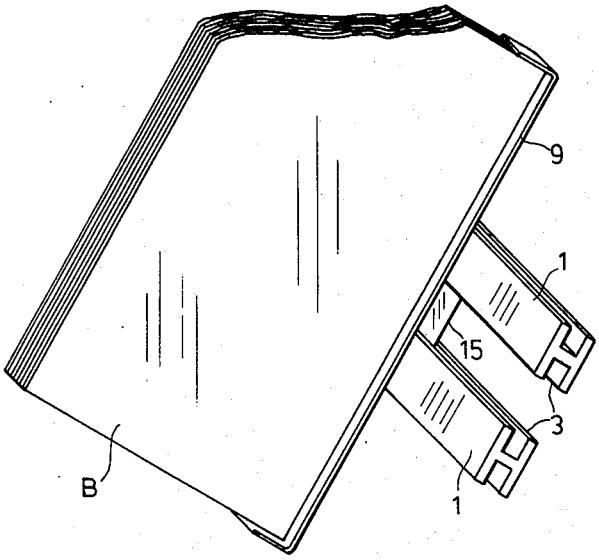

FIG. 8 shows an alternate arrangement for hanging a file according to the present invention from that shown in FIGS. 1 and 2.

Figure 9:
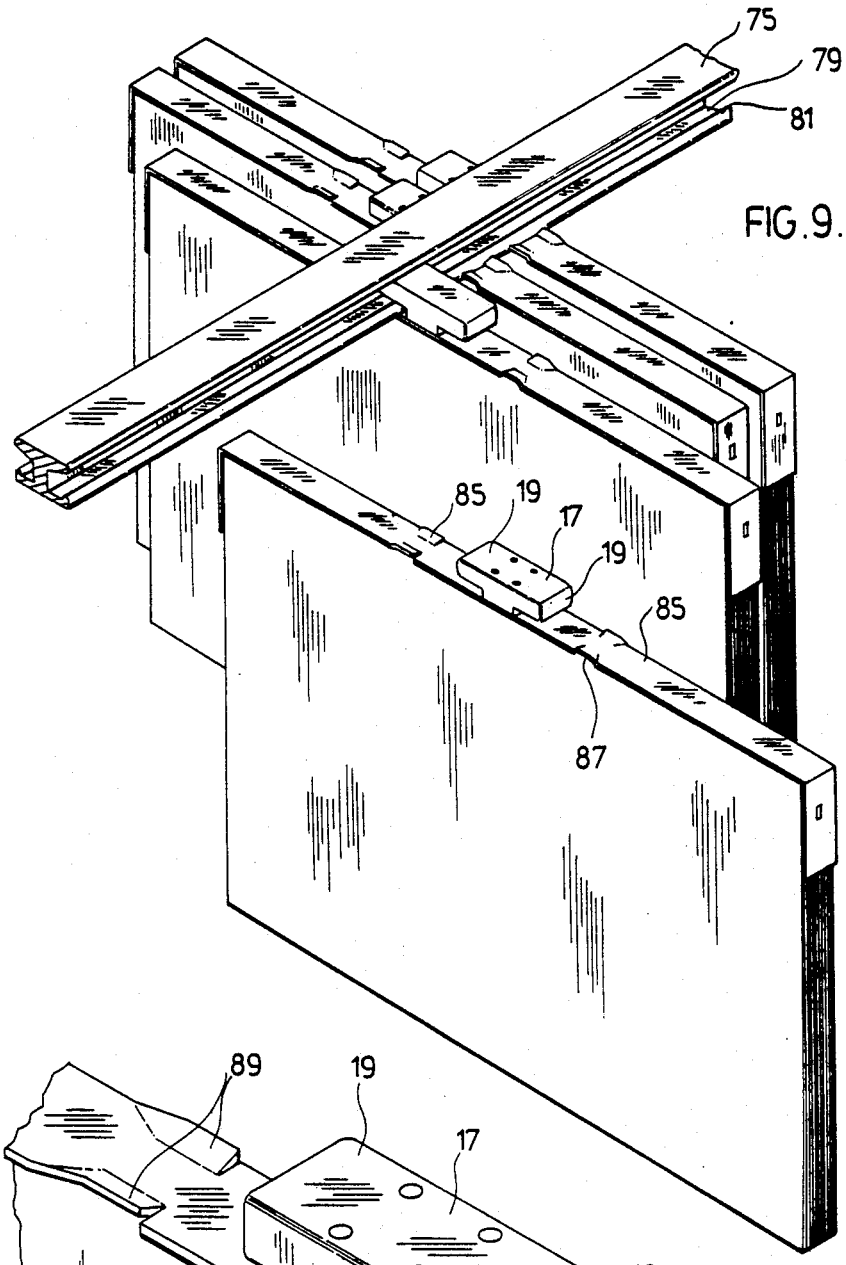

FIG. 9 is a top perspective view of a further preferred embodiment of the file hanging system of the present invention.

Figure 10:
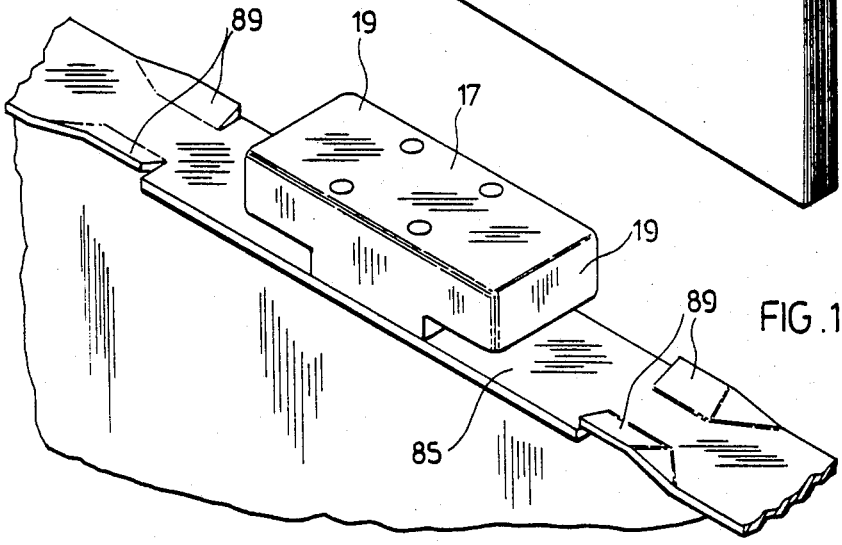

FIG. 10 is a top perspective view of the file edge backing arrangement on the file shown in FIG. 9.

Figure 11:
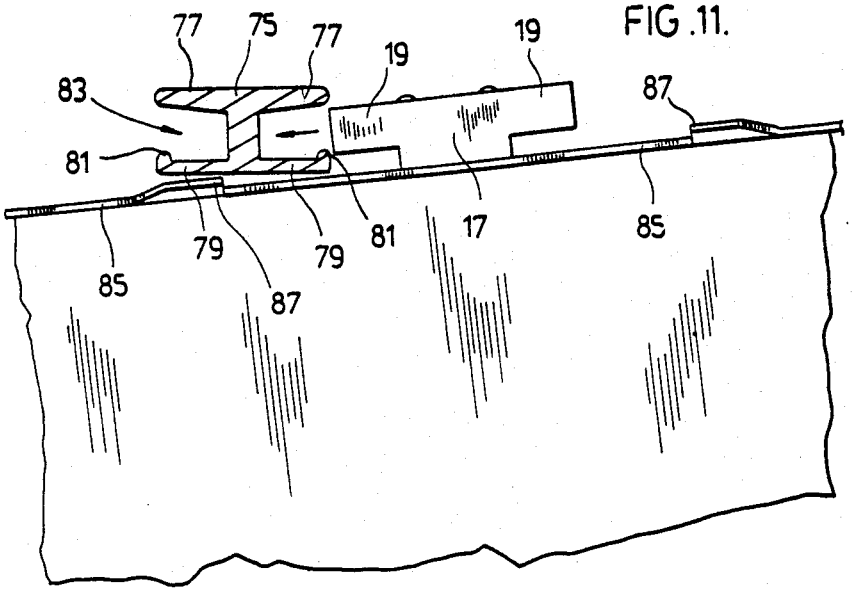

FIG. 11 is a side view of the file edge backing arrangement of FIG. 10 showing in section the supporting bracket of FIG. 9 with the file being located in position on the bracket.

Figure 12:
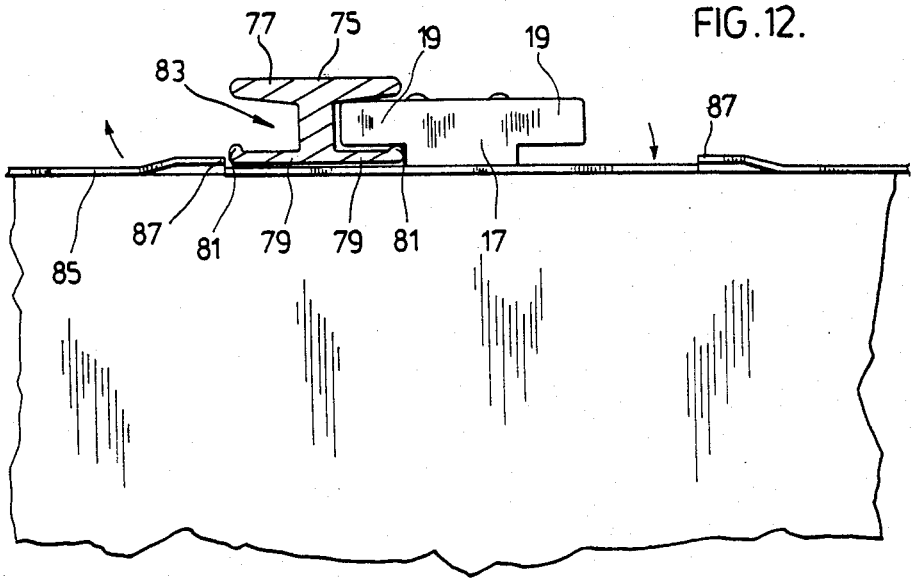

FIG. 12 is a view similar to FIG. 11 showing the file edge backing arrangement locked in position on the supporting brackets.

DETAILED DESCRIPTION ACCORDING TO THE PREFERRED EMBODIMENTS

According to FIGS. 1 and 2, which show a file hanging in the horizontally disposed direction, the file hanging system includes a file backing member 9 provided along the edge of a file F and suspended from a supporting bracket 1. In this preferred arrangement, the bracket is provided with a pair of U-shaped grooves 3, one on either side of the bracket. The grooves are bounded by upper flange 7, lower flange 5 and central bracket portion 6. As will be seen from the drawings, the U-shaped grooves open in opposing directions.

File edge backing member 9 is provided on its upper surface with a T-shaped member 15. The T-shaped member includes a central, upright or stem portion 17. At the upper end of the stem portion extend the ends 19 of the cross portion of the T-member. Studs 23 secure the T-member to the file edge backing 9. As is best shown in FIG. 2, the upright portion of the T-member is centered on the mid-point 18 of the backing with cross portion ends 19 extending to either side of the mid-point and aligned with flange 10 of the backing means.

The file edge backing is also provided with rib portion 11, extending downwardly from the main flange 10. This rib portion is inserted directly into the file edge, to secure the backing in place as will be more fully explained with reference to FIG. 3. In addition, rib 11 provides rigidity and support to the backing member.

FIGS. 3*a* and 3*b* shown in greater detail, the end construction of the backing member. Rib 11 is provided at its outer end 11*a* with a projecting lug 29. Flange end portion 13, which prior to assembly extends beyond the rib as shown in FIG. 3*a*, is provided with a receiving aperture 27. This flange end portion is then bent downwardly and pressed against rib end 11*a* with stud 29 fitted in aperture 27. Finally, the stud is flattened to provide a permanent locking arrangement wherein, end portions 13 wrap around the edge of the file. These wrap around end portions not only provide protection at the corner of the file where the file papers would otherwise be subject to fraying and bending but in addition, provide a surface for the application of a file code, such as that shown in FIG. 1. With the horizontally hanging file arrangement the code is immediately apparent at the exposed edge of the file, for easy file identification to anyone looking through the filing system for a specific file.

To see exactly how the file edge backing is secured along the file edge, reference is made to FIG. 3 which additionally shows the use of file edge binding means. The file, generally indicated at F is formed by a plurality of papers such as looseleaf papers or printout sheets, and the like, through which openings 26 have been provided. The rib portion 11 of the file edge backing is fitted between the file papers, preferably somewhere near the center of the file, and the file edge is forced against the bottom side of flange 10 with end portions 13 overlapping the corner of the file as described above. It is to be understood that the file edge backing can be cut to any desired length to accommodate the length of the particulr file to which it is secured.

The binding system used in conjunction with the backing consists of a pair of rigid support members 31 and securing fasteners 33. The rigid support members are end portions apertured at 35 and aligned with the placed at the file edge as shown in FIG. 3 with their apertures, the downwardly depending rib of the backing member itself is apertured as shown at 25 and these openings 26 through the file. In addition, to these apertures are also in alignment with openings 26 and 35. The entire arrangement is then bound together by means of fasteners 37 which are fitted through the binding system, the file papers and the backing and secured by locking member 39. These locking members are fitted over the exposed ends of the fasteners and locked in place by a tooth and groove arrangement provided on the exterior of the fastener and the internior of the locking member which makes it easy to fully tighten the support members along the file edge so as to bind the file with the backing member secured in place.

The file is hung from the supporting bracket as shown in FIGS. 1 and 2. Depending upon which direction one wishes to hang the file, one of the ends 19 of the cross portion of the T-shaped member is fitted into one of the U-shaped grooves provided in bracket 1. It will be noted that the file can be turned through 180 degrees and hung by the other end of the T-member cross portion if desired. Since the T-member extends upwardly from the file edge backing to an exposed position and because of its unique binding arrangement which will be described later in detail, very little, if any, manipulation of the T-shaped member is required to fully locate it in place which is hightly advantageous over the conventional hook arrangments particularly when working with a heavy file or in a crowded filing area.

Initially, it would appear that the simple combination of a U-shaped groove and T-shaped member would not be capable of holding the file in place in the horizontally disposed direction in the absense of a hook member as shown in the prior art. However, the unique construction of the present invention unexpectedly, and effectively, prevents the T-shaped member from falling out of the U-shaped groove and at the same time permits its sliding along the groove.

These features of the invention result from the positioning of the T-shaped member on the file edge backing. As is best shown in FIG. 2, the point of support for the file where the U-shaped groove engages the T-member is offset or to one side of the mid-point 18 of the file edge backing means which results in a file imbalance and moves the T-member to a binding engagement in the U-groove. According to FIG. 2, the center of gravity of the file is located to the right of the supporting bracket such that the file pivots slightly in the clockwise direction, forcing the secured end of the T-member, up against the bottom side of the flange portion 7. At the same time, the upper surface of the backing flange 10 is forced into contact with the base of bracket flange 5. The pivoting movement of the file is limited due to the close tolerances between the T-member and the U-groove so that the coefficients of friction between all of the contacting surfaces is more than adequate to prevent the T-member from falling out of the groove. Furthermore, additional weight in the file i.e., a larger file has the added effect of providing increased frictional contact so that regardless of the file weight, it is maintained in the frictionally secured position.

In the various embodiments of the invention described above and shown in FIGS. 1 through 7, a securing action of the T-shaped member in the groove occurs through the frictional contact and the binding created by the file imbalance which drives the T-shaped member against the supporting bracket. FIGS. 9 through 12 show a further preferred embodiment of the present invention having a supplementary securing action also created by the file imbalance.

Supporting bracket 75 shown in detail in FIGS. 11 and 12 has a pair of upper flange portions 77 which are slightly tapered such that they are relatively thicker towards the centre of the bracket. The lower flange portions 79 at the bottom of the bracket are provided with upwardly extending ribs 81 at each side of the bracket. The spacing of the upper flange from the lower flange provides a groove or channel 83 running along either side of the supporting bracket.

The filing edge backing system provided on each of the files comprises a T-shaped member 15 having arm portions 19 identical to the arrangement shown in FIGS. 1 through 8. However, the actual backing portion 85 running along the edge of the file is somewhat different from the earlier arrangement in that it is provided with a raised region 87 on each side of the T-shaped member. The raised region comprises a pair of dog ears 89 bent upwardly from the backing 85 as shown in FIG. 10. These dog ears are spaced outwardly of the central stem of the T-shaped member by a distance corresponding to the width across the supporting bracket.

The embodiment of FIGS. 9 through 12 is consistent with the earlier embodiments in that the T-shaped member is received by the supporting bracket regardless of its direction of insertion.

In order to locate the T-shaped member within the supporting bracket the desired arm portion 19 is directed at the appropriate channel 83 of the bracket. The file must be slightly tipped as shown in FIG. 11 in order to clear the arm portion through the opening to the channel. When the arm portion is pushed all the way into the channel the file imbalance tends to tip the file in the clockwise direction as shown in FIG. 12. If the file were inserted from the other side of the supporting bracket it would tip in the anti-clockwise direction. When the file tips through the file imbalance, the backing portion 85 drives into the base of the supporting bracket. As is clearly shown in FIG. 12, the two lower flanges at each side of the supporting bracket are trapped between the T-shaped member 17 and the raised region 87 of the file backing 85. With this arrangement the file is prevented from moving sideways relative to the supporting bracket due to the locking action in which the lower flanges of the bracket are trapped between the T-shaped member and the raised region provided by dog ears 89. Therefore in order to remove the file from its hanging position it must be manually tipped out of its naturally assumed position to clear the dog ears beneath the lower flange whereby the T-shaped member can be withdrawn from the supporting bracket.

The thickening of the upper flanges towards the centre of the supporting bracket and the provision of ribs 81 assures that once the arm portion of the T-shaped member is fit into the channel the file is locked against up and down movement. The shaping of the grooves has a wedge effect where the channels decrease in height from the outside inwardly from ribs 81. This provides adaquate clearance past the ribs to enable the arm portion to fit into the channel when the file is tipped as shown in FIG. 11. It also assures that once the file has moved to the FIG. 12 position the arm will drive against the downwardly tapering undersurface of the upper flange as it pivots on the rib 81 at the open side of the channel. Therefore even though there is a gap beneath the bottom of the arm portion and the lower flange inwardly of the rib the arm portion is still effectively wedged between the rib and the undersurface of the upper flange.

One particularly advantageous feature of this embodiment is that when there are files hanging side-by-side in contact with one another, as is often the case in a crowded filing system, a single file can be pulled out without inadvertantly pulling other files out with it. Furthermore the placement of the file onto the supporting bracket is facilitated by the provision of the dog ears which naturally tend to tip the file to the FIG. 11 position as they ride along the bottom of the bracket. After the dog ears have cleared the bottom of the bracket the T-shaped member is fully located in position at which point the bracket is clamped between the T-shaped member and the dog ears rock by simply releasing the file.

It will be readily understood from an analysis of the drawings that the securing principles described above, apply regardless of the direction of insertion of the T-member into the groove. In other words, the file can hang by either of the ends 19 of the T-member cross portion. This feature again results from the positioning of the symmetrical T-member on the file edge backing so that the file imbalance required to secure the T-member in the is always present regardless of which direction it is inserted into the grooves.

The file hanging system described with respect to FIGS. 1, 2 and 8 through 11, is particularly suited to filing cabinets closed from above and open to the sides, as shown in FIG. 4. In this arrangement, bracket 1 is secured to the underside of the cabinet top 43 by means of securing bolts or screws 45. Cabinet 41 is open from its side where the hanging files F are fully accessible. The coded backing ends 13 are readily apparent to anyone using the filing cabinet. Should further files be added to the cabinet, they are quickly and easily inserted in place, and if required, the files presently in the cabinet are slid along the supporting bracket to make room for the additional files.

A further type of filing cabinet is shown in FIGS. 6 and 7 of the drawings. This cabinet is again used for the horizontal type of filing system of FIGS. 1, 2 and 8 through 11.

Cabinet 61 may include a plurality of vertical shelving units 71, enclosed at the ends by end walls 67 and accessible from the sides through sliding door 63. A support beam 65 is mounted to each of the endwalls and is cut out to receive an end of supporting bracket 1 as best shown in FIG. 7. This same arrangement is used in each of the shelf compartments of the filing cabinet. Rollers 69 around which sliding door 63 pivots, are provided adjacent the open side of the cabinet. As the door is pulled outwardly, it rolls over and pivots around rollers 69 to close off the open side of the cabinet and to cover any files hanging in the cabinet.

The feature of the present invention described above with respect to use of either of the ends of the cross portion of the T-member for hanging the file, is particualy desirable when working with a filing system arrangement as shown in FIG. 5 of the drawings. This arrangement takes advantage of not only the symmetrical shape of the T-member but also takes advantage of the symmetry of the supporting bracket with its opposing grooves. This system which cannot be achieved through the use of conventional file hanging arrangement is one in which files F and Fa are hung on either side of bracket 1 (or bracket 75 when used) and accessible to persons occupying chairs 53 and 53*a* respectively. Filing cabinet 55 in which supporting bracket 1 is secured is open from both sides so that an individual for instance, sitting in chair 53 and working at desk 51 can easily gain access to files F. On the other hand, an individual working at desk 51*a* need only to turn his or reach over and select anyone of the files Fa which he or she, desires to work on. Moreover, because of the direction in which the files extend, it is readily apparent which files are hung on which side of the rack; i.e. files F extend toward chair 53 while files Fa extend towards chair 53*a*. Should the individual working on one of the files F comlete that file he can then pass it over to the individual working on files Fa. The file can quickly and easily be hung on the other side of the bracket to form part of the group of files Fa. The same situation applies for any of the files Fa, which can be passed over to the indivudial working on files F, by virtue of the fact that the T-shaped member is not limited in its direction of insertion in the double groove bracket.

It should again, be noted that even with this double opensided cabinet arrangement, the files are moved easily in and out of the filing cabinet.

FIG. 8 shows the use of the present invention in a vertical as opposed to a horizontal filing arrangement. Such an arangement is commonly found with pricing binders and the like. The system includes an edge backing member 9 identical to that earlier described secured to binder B. Backing member 9 is provided with T-shaped member 15, the two cross portion ends of which are secured in the facing grooves 3 of aligned brackets 1. It will be noted that although the brackets are aligned, the upper of the two brackets is not directly above the lower bracket but it is shifted slightly so that the binder B is tilted rearwardly from top to bottom. This rearward tilting makes the binder easier to read from above and helps to keep the binder open at a certain desired page.

With this arrangement, the support for the binder is provided by the interlocking action between the lower supporting bracket and the downwardly facing end of the T-member so that the weight of the file, locks the two in place. The upper bracket which is not required to support the file is only used in cases where the binder is maintained at a relatively permanent location and prevents upward withdrawl of the T-member from the lower bracket. In the arrangement shown in FIG. 8, the binder is moved by sliding it along the facing grooves 3 of brackets 1.

As mentioned above, the upper bracket need not be present to support the pricing binder. In the arrangement shown in the drawings, the T-member is again located such that its center stem portion is secured centrally of backing 9 with the ends of the cross portion of the T-member extending to either side of the mid-point of the backing member. When the upper bracket is removed, the file imbalance again tends to move the T-member to a locking position in the U-groove of the bracket. If additional support for this arrangement is required, both the depth of the U-groove and the length of the T-member cross portion may be increased to add to the locking action. Furthermore, it should again be noted that if reversal of the file direction is required (for example, where the binder printed in two or more languages) then the combination of the T-shaped member and the U-shaped groove is useable regardless of the direction in which the T-member is inserted into the groove.

As will be clearly understood from the foregoing, the simplicity and ease of use of the present invention, make it a highly desirable arrangement for a plurality of different types of filing systems. For example, the file shown in FIGS. 1 and 2 can be used with the vertical filing system of FIG. 8 and vice versa. The system is economical from both a cost and a space requirement standpoint. Moreover, it lends itself to arrangements such as that shown in FIG. 5 which were previously not possible and this as well as other unexpected advantages come about, due to its novel construction and unique arrangement of components.

Although various preferred embodiments of the invention have been described herein in detail, it will be apparent to one skilled in the art that variations may be made thereto, without departing from the spirit of the invention or the scope of the appended claims.

The embodiments of the invention in which an exclusive property or privilege is claimed are defined as follows:

1. A file hanging system consisting of a file edge backing means provided with a T-shaped member having a central column positioned at a balance point on said file edge backing means and a pair of essentially identical arm portions extending outwardly from either side of said central stem and bracket means provided with a groove for engaging either one of said arm portions of said T-shaped member, said bracket means being provided with a base flange beneath said groove and said file edge backing means being provided with a raised portion to either side of and spaced from said T-shaped member, this system being such that when either one of the arm portions of said T-shaped member is inserted in said groove the weight of a file to which said file edge backing means is affixed moves said T-shaped member to a secured position in said groove with said base flange on said bracket means being trapped between said T-shaped member and one of the raised portions on said file edge backing means.

2. A file hanging system as claimed in claim 1 wherein said base flange is provided with upwardly extending rib means on which said T-shaped member is adapted to pivot through the file imbalance to the secured position.

3. A file hanging system as claimed in claimed in claim 1 wherein said bracket is H-shaped with opposing grooves to either side thereof with said base flange extending beneath each of said grooves.

4. A file hanging system as claimed in claim 3 including an upwardly extending rib on said base flange in each of said grooves.

* * * * *